US005083385A

United States Patent [19]

Halford

[11] Patent Number: 5,083,385

[45] Date of Patent: Jan. 28, 1992

[54] FOOTWEAR HAVING INTERCHANGEABLE UPPERS

[76] Inventor: Catherine J. P. Halford, 15 Avenue Bosquet, Paris, France, 75007

[21] Appl. No.: 578,067

[22] Filed: Sep. 5, 1990

Related U.S. Application Data

[63] Continuation-in-part of Ser. No. 560,431, Jul. 31, 1990, abandoned.

[51] Int. Cl.[5] ..... A43B 3/24

[52] U.S. Cl. ..... 36/101; 36/100

[58] Field of Search ..... 36/100, 101, 15

[56] References Cited

U.S. PATENT DOCUMENTS

| | | | |
|---|---|---|---|
| 1,051,448 | 1/1913 | Rasmussen | 36/15 X |
| 1,260,901 | 3/1918 | Hayhurst | 36/15 |
| 2,368,960 | 2/1945 | Anson | 36/15 |
| 2,491,930 | 12/1949 | Parlante | 26/2.5 |
| 3,538,628 | 11/1970 | Einstein, Jr. | 36/15 |
| 3,846,919 | 11/1974 | Milotic | 36/100 |
| 3,906,646 | 9/1975 | Milotic | 36/2.5 C |
| 4,062,132 | 12/1977 | Klimaszewski | 36/100 |
| 4,267,650 | 5/1981 | Bauer | 36/101 |
| 4,317,294 | 3/1982 | Goodyear | 36/100 |
| 4,377,042 | 3/1983 | Bauer | 36/101 |
| 4,420,894 | 12/1983 | Glassman | 36/12 |
| 4,439,935 | 4/1984 | Kelly | 36/101 |
| 4,887,369 | 12/1989 | Bailey et al. | 36/101 |
| 4,974,344 | 12/1990 | Ching | 36/100 X |

FOREIGN PATENT DOCUMENTS

| | | | |
|---|---|---|---|
| 0498299 | 1/1951 | Belgium | 36/15 |
| 1116969 | 5/1956 | France | 36/15 |
| 0495976 | 12/1954 | Italy | 36/15 |
| 0530275 | 6/1955 | Italy | 36/15 |
| 0023401 | of 1906 | United Kingdom | 36/15 |

OTHER PUBLICATIONS

UK Patent Appl. GB 2178940A, 2/1987.

*Primary Examiner*—Paul T. Sewell
*Assistant Examiner*—Ted Kavanaugh
*Attorney, Agent, or Firm*—Brumbaugh, Graves, Donohue & Raymond

[57] ABSTRACT

The interchangeable upper of the disclosed footwear includes a foot covering adhesively secured to an insole molded of relatively flexible, shock-absorbent material to a desired shape, size and thickness, and having a narrow shoulder surrounding its upper surface. This insole is received in a one-piece outsole molded from a material having memory, so as to always seek to return to its original molded shape, which has a bottom corresponding in size and shape to the insole which is surrounded by an upstanding wall having a height which corresponds to the thickness of the insole and a narrow lip extending inwardly from its upper edge. During molding, the bottom may be made flat or, alternatively, the portion of the bottom from the heel to the widest part of the foot may be made flat and the portion forward thereof gently curved upwardly from the plane of the flat portion. The lip on the outsole mechanically engages the shoulder on the insole, and because the outsole attempts to return to its molded shape any tendency of the outsole to gap at the upper edge with stepping movement is essentially prevented. The material of the outsole is sufficiently elastic to secure insole and outsole together, yet to be stretched the small amount necessary to release the lip from the shoulder for removal of the outsole.

11 Claims, 2 Drawing Sheets

FOOTWEAR HAVING INTERCHANGEABLE UPPERS

CROSS-REFERENCES TO RELATED APPLICATION

This application is a continuation-in-part of application Ser. No. 07/560,431 filed July 31, 1990, now abandoned.

BACKGROUND OF THE INVENTION

1. Field of the Invention

This invention relates generally to footwear and, more particularly, to a transformable shoe having an outer sole and interchangeable uppers adapted to be securely, yet removably, connected to the outer sole.

2. Discussion of the Prior Art

The prior art is replete with examples of footwear having changeable components, to achieve a variety of purposes. For example, Bauer U.S. Pat. No. 4,377,042 describes an athletic shoe wherein one of several replacement outsoles, each with a different tread, can be removably connected to an upper so that the wearer, with an investment in only one pair of uppers and an assortment of outsoles, can attach to the upper the outersole having a tread most appropriate for a selected sports activity and playing surface. The upper consists of a foot covering adhesively secured to an insole consisting of a layer of polyethylene or urethane sandwiched between two layers of sponge rubber. An outwardly directed recess is formed in the outer edge of the polyethylene layer and extends completely around the insole The outsole has an upstanding rim completely surrounding its periphery in which is formed a bead which mechanically engages the recess formed in the insole for detachably connecting the upper to the outsole, and mating layers of mechanical binders such as Velcro or Duallock, a trademark product of 3M Company, provide additional locking between the insole and outsole.

U.S. Pat. No. 4,887,369 to Bailey et al. describes a convertible shoe consisting of a shoe bottom having a forward outsole portion, a middle shank and a raised heel, and a shoe top having a midsole, an insole and an upper vamp. The upper vamp is detachably secured to the midsole with snap connectors, and the midsole is detachably secured to the outsole with a plurality of snap fasteners.

Glassman U.S. Pat. No. 4,420,894 discloses a shoe made from a pre-formed flexible insole having a plurality of male snap elements on its underside, which snap elements are received and permanently held by corresponding female snap indentations on the topside of a pre-formed outsole so that the two soles can be quickly aligned and fastened permanently together by adhesive placed between the soles during assembly.

U.S. Pat. No. 2,491,930 describes a shoe with interchangeable uppers consisting of a lower section having conventional toe, sole, vamp and shank portions and a heel affixed thereto and an upper member which may take a variety of shapes and colors and along its lower edge is equipped with a string of slide fastener elements which cooperate with slide fastener elements attached along the upper edge of the lower element to secure the upper to the lower section.

It is an object of the present invention to provide a transformable shoe wherein an upper part having a relatively light weight insole can be quickly and easily detachably connected to an outsole, so that the user not only may change the color and appearance of the shoe to conform to the apparel being worn, but also realize considerable savings by having one pair of outsoles with an assortment of interchangeable uppers taking the place of several pairs of shoes.

Another object of the invention is to provide a shoe having an outsole with interchangeable uppers in which the uppers have utility independently of the outsole, as a house slipper, for example.

Another object is to provide a shoe having an outsole with interchangeable uppers in which the uppers may be made from materials amenable to laundering

SUMMARY OF THE INVENTION

Briefly, the shoe construction according to the invention consists of an upper having a sock-like foot covering formed of leather or a suitable fabric, adhesively secured to an insole which is easily and inexpensively molded from a relatively flexible, lightweight and shock-absorbent material, such as the PLU material used for making the soles of athletic shoes, to a desired shape, size and thickness. The upper surface of the insole is contoured in conventional manner to provide support for the foot and has a narrow shoulder disposed slightly below and completely surrounding the outer edge of the upper surface.

An outsole, easily and inexpensively molded in one piece from rubber, for example, has a bottom of the same shape and size as a mating insole surrounded by an upstanding wall the height of which at any point corresponds to the thickness of the insole, and a lip extending inwardly from the upper edge of the wall having dimensions corresponding to the shoulder dimensions. In the molding process the outsole may be formed to have a substantially flat shape; that is, to have a shape in the vertical plane which corresponds essentially to the shape of the insole. Alternatively, it may be formed to have a "banana" shape in a vertical plane in that the portion from the heel to the widest part of the foot is flat and the portion forward therefrom is curved upwardly from the plane of the flat portion. Thus, when a wearer of the upper part (i.e., insole and attached upper) steps into the outsole the upwardly turned portion is flattened and the insole is guided under the inturned lip, with minimal guidance. The "memory" molded into the outsole causes it to return to its curved shape so as to overcome the tendency of the upper edge to gap with stepping movement (i.e., toe down, heel up) and to insure against separation of the sole from the shoe even if subjected to the rigors of athletic activities.

Other objects, features and advantages of the invention will become apparent, and its construction better understood, from the following detailed description, taken in conjunction with the accompanying drawings.

DESCRIPTION OF THE PREFERRED EMBODIMENT

Figure 1:
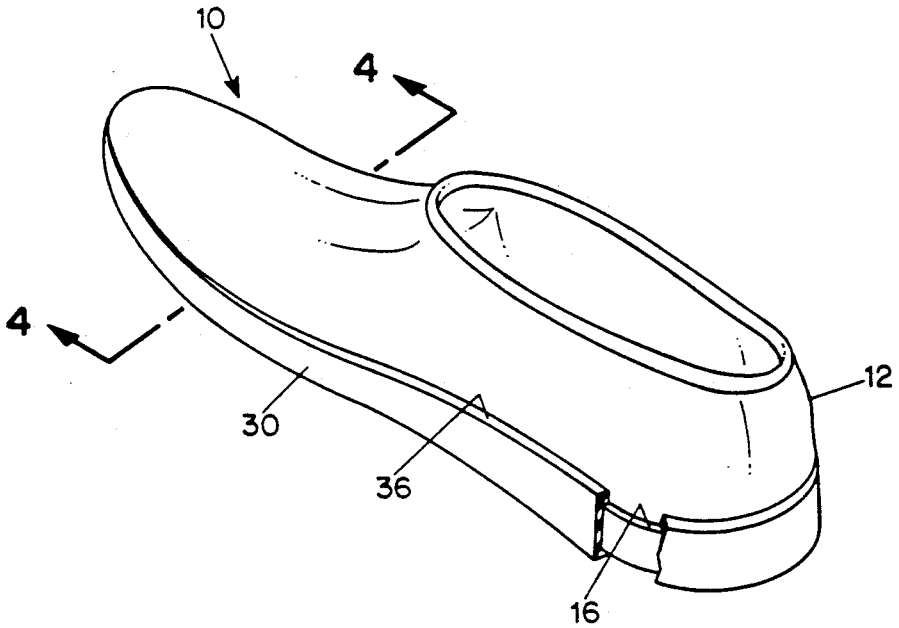
FIG. 1 is a perspective view of a shoe constructed in accordance with the invention.

Referring to the drawings, the shoe 10 according to the invention consists of an upper including a foot covering 12, which in the illustrated preferred embodiment is sock-like in construction, formed of any suitable material conventionally used for the manufacture of shoe uppers, ranging from fine leather to woven fabrics, including fabrics which may be laundered, the choice depending on the intended use of the footwear. It may be suede or finer leather for a dressier shoe, a washable white fabric for nurses' shoes, or a fabric having a texture and color suitable for athletic wear.

Figure 3:
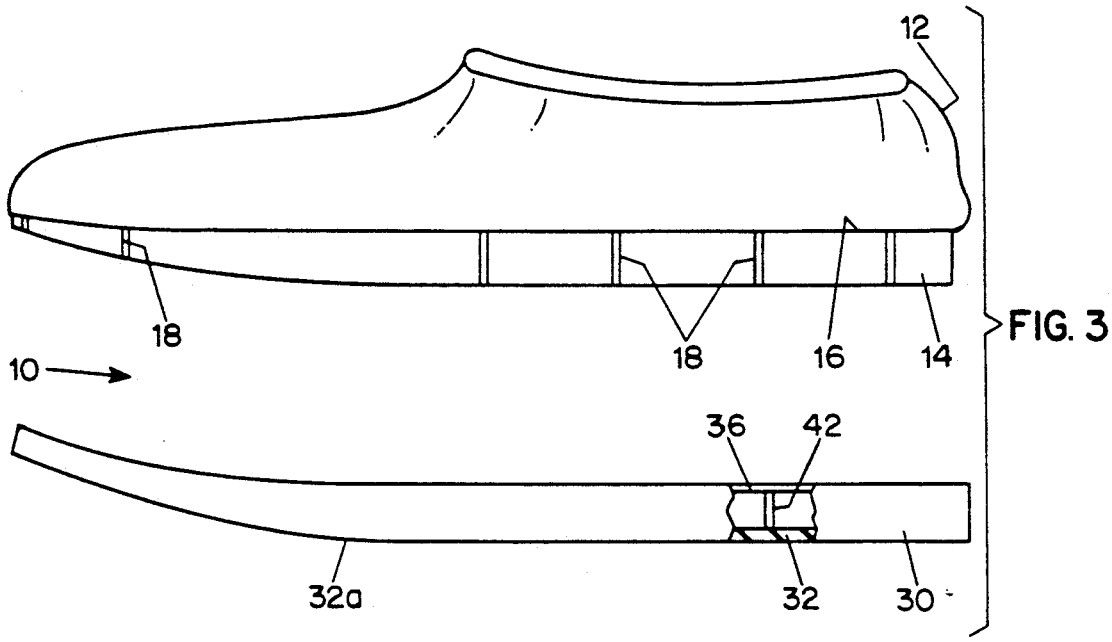
FIG. 3 is an elevation side view showing the upper removed from an upwardly turned outsole.

The underside of foot covering 12 is secured with a suitable adhesive (not shown) to an insole 14, which is preferably molded from a relatively flexible, lightweight and shock-absorbent material, such as the plastic material known as PLU and conventionally used for the manufacture of soles for athletic shoes. This material has air entrapped therein, the amount determining its weight and flexibility. As best seen in FIG. 3, the thickness of insole 14 is essentially uniform from the heel to the region at which the foot starts to widen; from this region forward it gradually becomes thinner and is also turned slightly upward. The thickness is slightly less in the immediate vicinity of the heel for walking comfort. A typical thickness at the thickest part is 17 mm (⅝ in.), tapering through the forward region to a thickness at the tip of the toe of 4 mm (¼ inch). The upper surface of the insole is contoured in conventional manner to provide comfortable support for the foot.

A narrow shoulder 16, formed during molding of the insole, completely surrounds the upper outer edge of the insole and forms a surface for engaging a mating surface of an outsole (to be described). Typically, the shoulder 16 is 3.5 mm (⅛ in.) wide and is disposed about 1.75 mm (1/16 in.) below the foot-supporting surface. A plurality of V-shaped grooves 18 are formed, preferably during molding, in the wall of the insole for positioning the insole within the outsole and preventing (in a manner to be described) relative movement between insole and outsole. In the illustrated embodiment there are six grooves on each wall of the insole, four uniformly distributed in the region extending from the heel to where the insole starts to widen and two located in the toe region.

Figure 2:
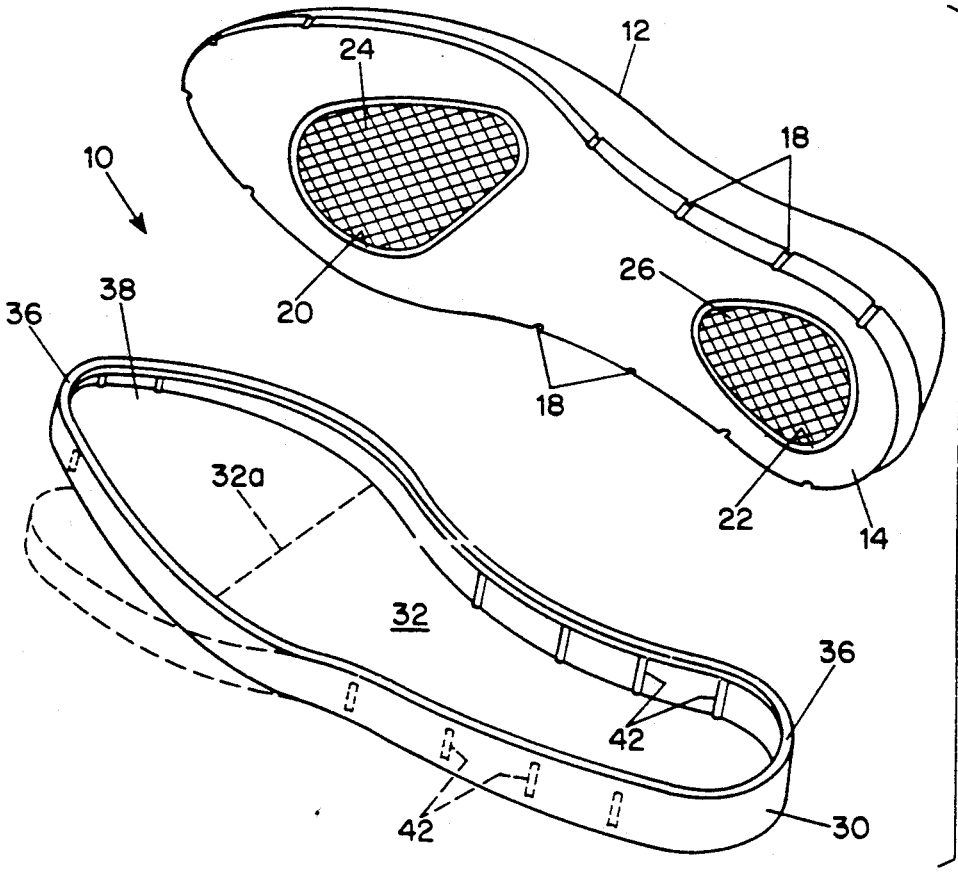
FIG. 2 is an exploded perspective view showing the upper removed from the outsole.

As best seen in FIG. 2, the underside of insole 14 has a pair of shallow cavities 20 and 22 molded therein at the ball and heel regions, respectively, in which correspondingly shaped patches 24 and 26 formed of rubber, or suitable plastic, are adhesively secured. The exterior surface of the patches is preferably roughened for increasing the friction between the insole and the inner surface of the outsole. Typically, the cavities are 3.5 mm (⅛ in.) deep and the patches 2.6 mm (3/32 in.) thick.

Figure 4:
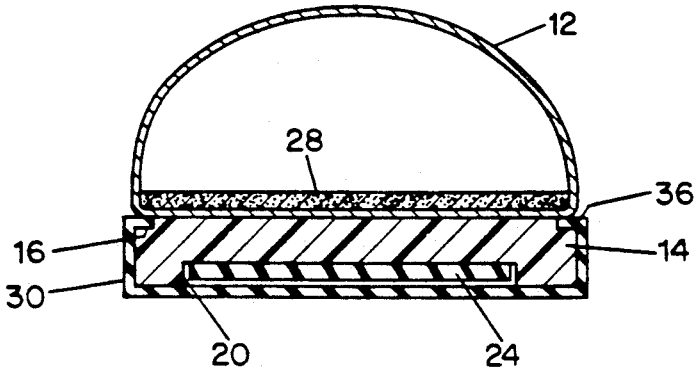
FIG. 4 is a sectional view taken along line 4—4 of FIG. 1.

It will be appreciated that the construction thus far described, with the optional insertion of a cushion inner sole 28 (FIG. 4), can be used, as is, as an article of footwear. The insole material is sufficiently durable to withstand walking, certainly around the house, and patches 24 and 26 provide traction should it be desired to wear the shoe for athletic activity. However, when outside wear is contemplated, for example, for walking home from an aerobics class where only the uppers were worn, the insole 14 is covered with an outsole 30 constructed and arranged in such a way as to be mechanically connected to the insole, without risk of separation of one from the other during walking and/or other activities.

Figure 3A:
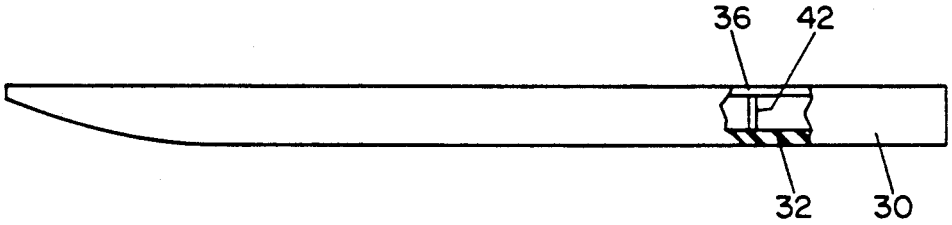
FIG. 3A is an elevation side view showing a flat outsole removed from the upper.

To achieve this result, outsole 30 is molded in one piece, preferably from natural or synthetic rubber, and has a bottom 32 shaped and sized to match the outline of an insole 10 with which it is to be used, and an upstanding wall 34 surrounding the bottom and which has an inturned lip 36 at its upper edge disposed at 90° with respect to the wall. The height of the surrounding wall, from the upper surface of bottom 32 to the underside of lip 36, at any point along its periphery corresponds to the thickness of the insole at corresponding points on the periphery of its shoulder 16, and the lip 36 has width and thickness dimensions corresponding to the width of shoulder 16 and the spacing between the upper surface of insole 14 and the horizontal surface of the shoulder 16, respectively. As seen in FIG. 3A, in the molding process the outsole may be formed so that its bottom 32 is flat throughout the region from the heel to toe, or alternatively, as shown in FIGS. 2 and 3, it may be formed with a flat bottom throughout the region from the heel to the widest part of the foot, indicated by dotted line **32*a*, and the portion forward of that line is gently curved upwardly from the plane of the flat portion such that the tip is raised above that plane by a distance approximating twice the thickness of the tip region of insole 14. This "bananashaped" curvature is "memorized" in the molding process with the consequence that each time the forward portion is flattened toward the flat plane, as will occur by toe down, heel up stepping movement, it tends to return to its original shape so as to tighten the grip on the shoulder 16 and prevent the tendency of the upper edge to gap at the wide part of the foot. In both cases, a portion of the wall 30 alongside the inside of the foot, indicated by the bracket 40**, is reinforced, by making it and the lip thicker for example, to make it stiffer than the rest of the wall for making it retain its molded shape, even when subjected to the above-mentioned stepping movement of the foot.

A multiplicity of V-shaped vertically-oriented ribs 42, complementary in shape, size and location with the grooves 18 formed in the walls of insole 14, project inwardly from the upstanding wall 34 and, when the insole is inserted, engage corresponding grooves 18 therein for correctly positioning the insole and preventing relative back and forth movement between the insole and outsole.

The upper and outsole are easily assembled by first putting the upper on the foot and then stepping into and sliding the insole forwardly in the outsole until the lip 36 engages the peripheral shoulder 16 of the insole; in the case of curved outsole, this causes the curved portion to be flattened with attendant slight stretching of the wall, mainly in the portion forward of dotted line **32*a*, which tightens its grip on the vertical wall surface and shoulder of the insole. During stepping movement, when the toe of the shoe is down and the heel is up, with bending of the foot occurring substantially only at about the point indicated by line 32*a*, where the foot is widest, the curved toe portion of the outsole attempts to return to the position imparted during molding and this, coupled with the stiffened wall at 40, prevents the tendency of the upper edge of the outsole to open or gap, at either side. With the foot in place, the fabric of the upper is stretched over and covers most, if not all, of the upper surface of the lip 36**, giving the appearance that the sole is secured to the upper by conventional means. The components are mechanically coupled together solely by the described coaction between the outsole and mating surfaces of the insole, without the use of or need for supplementary fastening means, yet the outsole is sufficiently elastic to be easily detached, if desired, by stretching it by the small amount necessary to release the lip from the shoulder.

While currently preferred embodiments of the invention and the best mode for practicing it have been illustrated and described, it will be understood that the invention is subject to design modifications, such as use of different materials than those specifically mentioned, within the scope of the appended claims.

I claim:

1. A shoe which is readily transformable by interchanging uppers, said shoe comprising two independent elements, (a) an upper assembly including a molded insole having foot-shaped top and bottom surfaces and a substantially vertical sidewall extending between said top and bottom surfaces, said insole having a shoulder of predetermined width surrounding the periphery of and spaced below said top surface and a multiplicity of vertically oriented grooves in said sidewall extending between said top and bottom surfaces and distributed along its periphery, and a foot-covering upper permanently attached to the top surface of said insole interiorly of said shoulder, and (b) a one-piece molded removable outsole having a bottom sole having an upper surface substantially corresponding in shape and size to the bottom surface of said insole, said bottom sole being surrounded by an integral upstanding peripheral wall having a lip of substantially said predetermined width extending perpendicularly inward from the upper edge thereof and engaging said shoulder along the periphery of said insole and having a multiplicity of vertically-oriented ribs on its inner surface distributed along its periphery so as to mate with respective grooves in the sidewall of said insole, the height of said upstanding wall between the upper surface of said bottom sole and the underside of said lip substantially corresponding to the distance between the bottom surface of said insole and said shoulder, whereby said outsole encloses the bottom and sidewall surfaces of said insole and is releasably connected thereto only be engagement of said lip with said shoulder along the periphery of said insole.

2. A shoe according to claim 1, wherein a first portion of the bottom sole of said outsole disposed between the heel and the widest part of the foot is flat and a second portion of said bottom sole extending forwardly from the first portion to the toe is gently curved upwardly from the plane of the flat portion whereby when the curved portion is forced downwardly into the plane of said flat portion by insertion of an insole the peripheral upper edge of said upstanding wall is stretched for tightening the grip of the outsole to the insole.

3. A shoe according to claim 2, wherein said outsole is molded from a material which possesses memory which causes said outsole to return to its original molded upwardly curved shape upon removal of the inserted insole.

4. A shoe according to claim 3, wherein said outsole is molded from rubber.

5. A shoe according to claim 1, wherein said outsole is molded from rubber.

6. A shoe according to claim 1, wherein the sidewall of said insole and the inner surface of the upstanding wall of said outsole having mating ribs and grooves for substantially preventing relative front to back movement between the insole and the outsole.

7. A shoe according to claim 6, wherein the sidewall of said insole has a multiplicity of vertically-oriented grooves formed therein distributed along its periphery, and wherein the inner surface of the upstanding wall of said outsole has a like multiplicity of ribs formed thereon and distributed therealong for engaging respective grooves in the sidewall of said insole.

8. A shoe according to claim 1, wherein said foot covering upper is formed of a material which when the shoe is worn by a user stretches sufficiently to substantially conceal the otherwise exposed upper surface of said lip.

9. A shoe according to claim 1, wherein said insole is formed of a material sufficiently durable to withstand walking thereon without the outsole and wherein the bottom surface of said insole has at least one roughened patch secured thereto for increasing the friction between the bottom surface of said insole and the upper surface of the bottom sole of said outsole.

10. A shoe according to claim 1, wherein the ribs on the inner surface of the upstanding wall of said outsole extend between the upper surface of said bottom sole and the underside of said lip.

11. A shoe according to claim 1, wherein the thickness of said lip is substantially equal to the spacing of said shoulder below the top surface of said insole.

* * * * *